US008025010B1

(12) United States Patent
Lund

(10) Patent No.: US 8,025,010 B1
(45) Date of Patent: Sep. 27, 2011

(54) METHOD FOR REDUCING CHARGE RETENTION PROPERTIES OF SOLID PROPELLANTS

(75) Inventor: Gary K. Lund, Ogden, UT (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 07/584,210

(22) Filed: Sep. 18, 1990

(51) Int. Cl.

| | |
|---|---|
| ***F42B 4/06*** | (2006.01) |
| ***C06B 29/22*** | (2006.01) |
| ***D03D 23/00*** | (2006.01) |
| ***D03D 43/00*** | (2006.01) |

(52) U.S. Cl. ..... 102/347; 149/76; 149/109.4; 149/109.6

(58) Field of Classification Search ..... 102/389, 102/291, 347; 149/108.8, 109.6, 109.4, 76; 252/567

See application file for complete search history.

(56) References Cited

U.S. PATENT DOCUMENTS

| | | | | | |
|---|---|---|---|---|---|
| 3,403,968 | A | * | 10/1968 | Brummet et al. | 8/116.2 |
| 3,419,498 | A | * | 12/1968 | Palumbo et al. | 252/63.7 |
| 3,890,877 | A | * | 6/1975 | Lista et al. | 86/1 |
| 4,481,337 | A | | 11/1984 | Burlett et al. | 525/340 |
| 4,537,848 | A | * | 8/1985 | Yourd et al. | 430/108.14 |
| 4,822,433 | A | * | 4/1989 | Cooper et al. | 149/2 |
| 4,931,509 | A | * | 6/1990 | Yagishita et al. | 525/208 |
| 5,071,577 | A | * | 12/1991 | Benjamin et al. | 252/46.6 |
| 5,081,194 | A | * | 1/1992 | Wolf | 525/340 |

OTHER PUBLICATIONS

Derwent Abstract 86-110388/17.
Derwent Abstract 84-294326/47.

* cited by examiner

*Primary Examiner* — Jerry Lorengo
*Assistant Examiner* — James E McDonough
(74) *Attorney, Agent, or Firm* — TraskBritt

(57) ABSTRACT

A quaternary salt is added at low concentrations to a solid propellant, thereby increasing the conductivity of the polymeric binder to provide for safe discharge of static electricity at relatively low potentials.

15 Claims, 3 Drawing Sheets

EFFECT OF ADDED ELECTROLYTE UPON ELECTRICAL PROPERTIES OF A MAGNESIUM/A.P./HTPB PROPELLANT

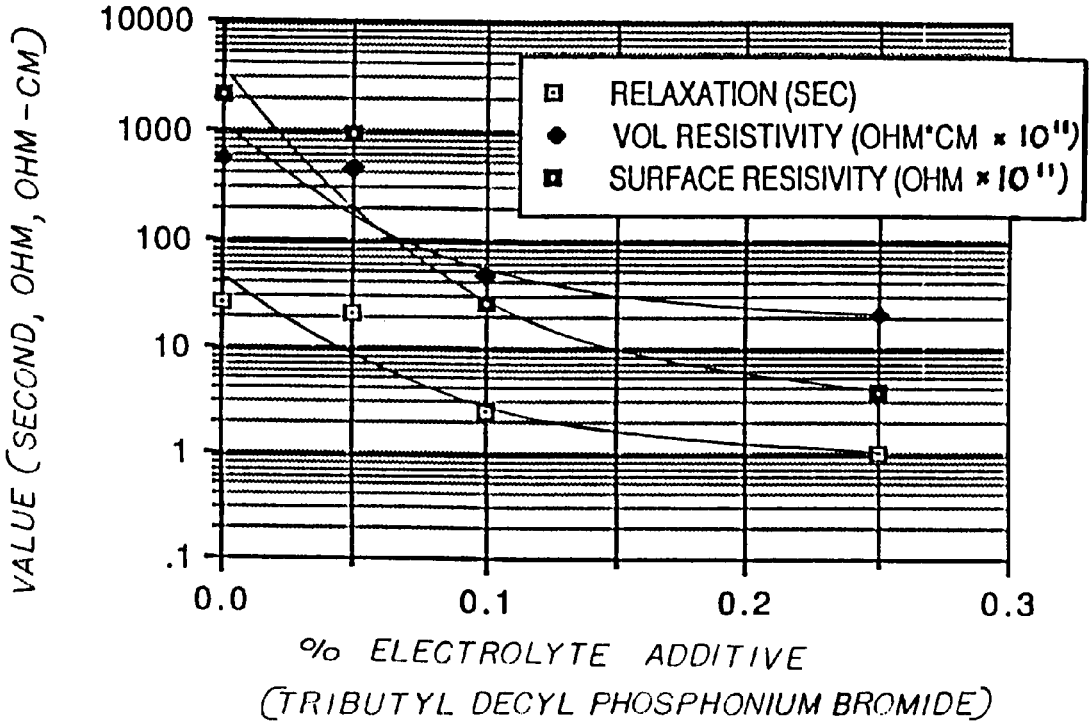
FIG. 1: EFFECT OF ADDED ELECTROLYTE UPON ELECTRICAL PROPERTIES OF A MAGNESIUM/A.P./HTPB PROPELLANT

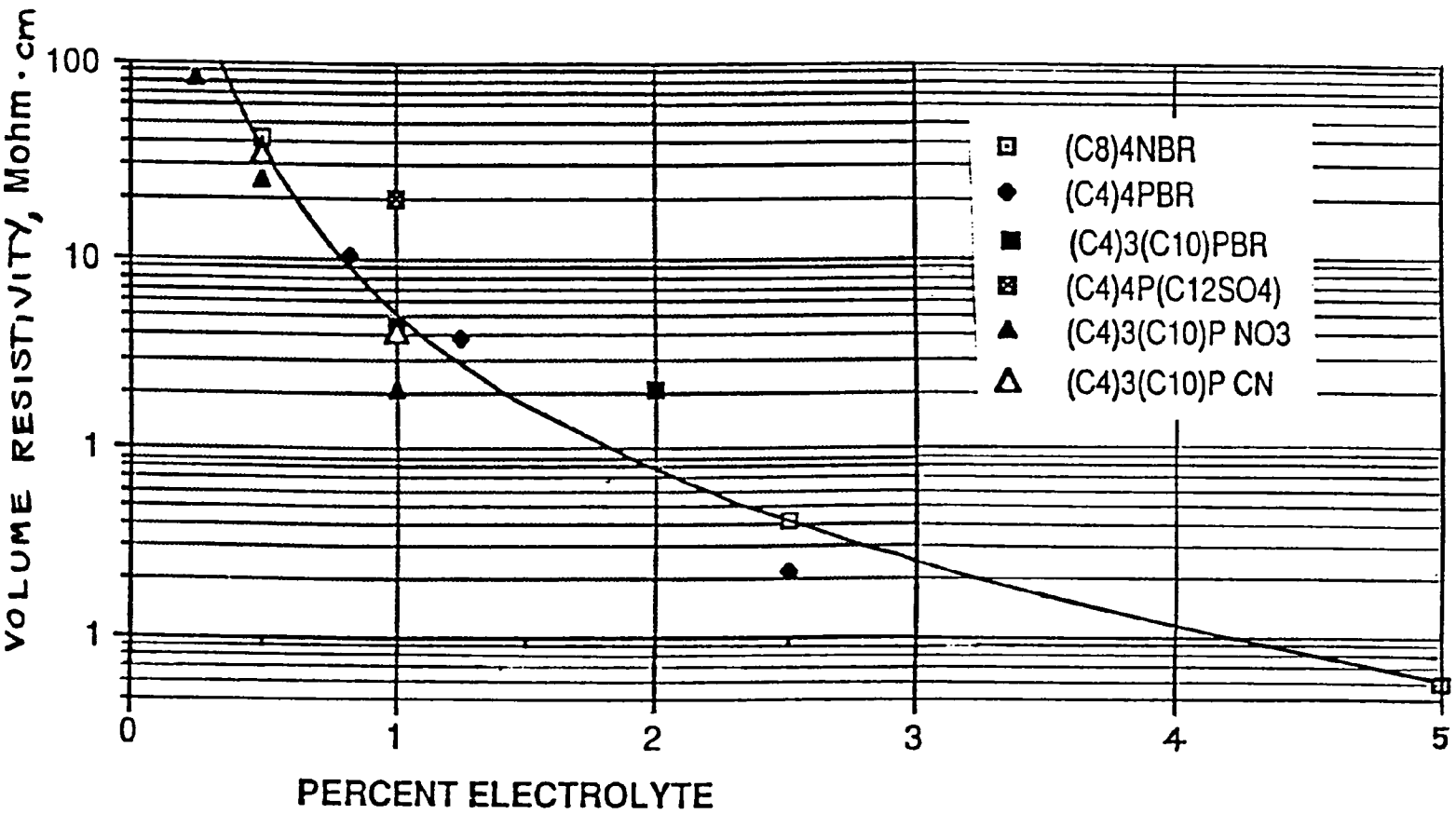
FIG 2: RESISTIVITY VS WEIGHT PERCENT ADDITIVE, HTPB BINDER, NO SOLIDS

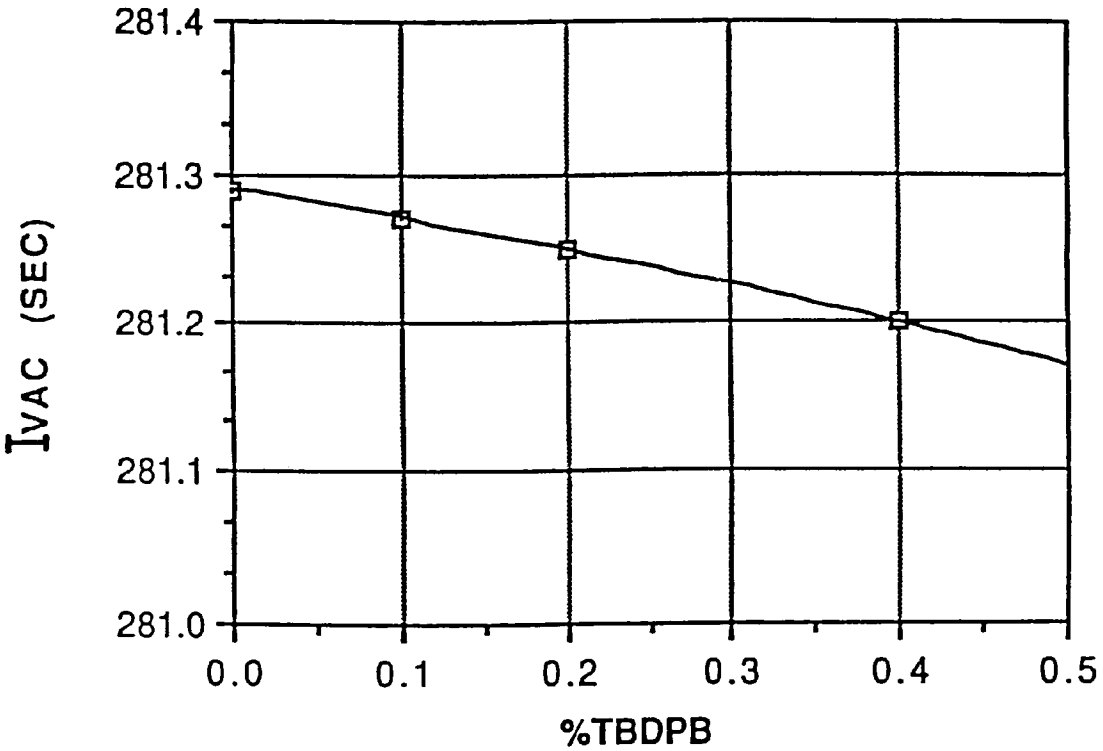
FIG. 3: SPECIFIC IMPULSE* VS % TBDPB ADDITIVE IN A MAGNESIUM/A.P./HTPB PROPELLANT.
*EXPANDED INTO VACUUM, 10:1 AREA RATIO

METHOD FOR REDUCING CHARGE RETENTION PROPERTIES OF SOLID PROPELLANTS

FIELD OF THE INVENTION

This invention relates to solid propellants such as used in rocket motors. It is particularly directed to methods for altering the electrical properties of solid propellants to reduce the possibility of premature ignition due to electrical discharge during manufacture, transportation, storing and deployment.

BACKGROUND OF THE INVENTION

The sensitivity of solid and liquid propellants to electrical discharge is well documented. Numerous sources of electrical discharge have been cited as possible causes of catastrophic premature ignition of rocket motors containing solid propellants. External sources include natural lightning, electromagnetic pulses, high power microwave energy, exoatmospheric particle impact following launch, and the like.

In addition, static electricity charges are normally present at the interfaces between the various phases in the propellant, insulation, liner and other parts of the rocket motor. Charging of surfaces may occur by surface-to-surface, i.e., triboelectric contact and by the cracking or separation of the solid phase, as in fractoelectrification.

Sudden discharge of this electrostatic energy may generate sufficiently high temperatures to ignite the solid propellant. Such catastrophic events have the potential for causing great property damage and loss of life. For example, an incident in 1985 with a Pershing II missile killed two soldiers in Germany. Subsequent analysis indicated that triboelectric charging and an ensuing discharge was capable of initiating the unintentional ignition.

One manufacturing operation, which has been implicated as a cause of catastrophic discharge and premature propellant ignition, is the core pulling operation, i.e., removal of molds from the solid propellant grain after the grain is cast.

Other manufacturing operations have the potential for causing rapid electrostatic discharge. Such events may also occur during storage, transportation, and deployment of the rocket motor.

Composite solid propellants have a very complex microstructure consisting of a dense random pack of particles embedded in a polymeric binder matrix. The particles typically comprise fuel, oxidizers, combustion control agents, and the like. The particles may have a wide variety of sizes, shapes and electrical properties. Electrostatic charges typically build up on the binder-filler interfaces as well as at the interfaces between other components of the propellant, e.g., at the interface between conductive particles such as aluminum powder and a non-conductive or less-conductive binder.

The measurable electrostatic properties useful for evaluating binders and propellants include volume resistivity, surface resistivity, dielectric constant, dielectric breakdown strength, and relaxation time constant.

Volume resistivity and surface resistivity are measures of the propellant's ability to dissipate static energy imposed upon it. Mathematically, resistivity is the reciprocal of conductivity.

The dielectric constant is a measure of the propellant's ability to store electrostatic energy.

The dielectric breakdown threshold is a measure of how much electrostatic potential the propellant may be subjected to before a catastrophic breakdown occurs.

The relaxation time is the time taken by the propellant to dissipate an electrostatic charge.

Certain solid rocket propellants have a relatively high conductivity. For example, a propellant may contain HMX, i.e., Her Majesty's Explosive, ammonium perchlorate (AP) and aluminum in a binder of a nitrate ester plasticizer and polyethylene glycol (PEG). The latter complexes ammonium or alkali metal cations to dissolve several percent of the AP, theoretically providing a substantial population of dissociated ionic species available for charge transport. Thus, electrostatic charges are readily dissipated and catastrophic discharge is extremely unlikely with this type of propellant binder system.

In another propellant, the solid constituents are bound in a poybutadiene acrylonitrile/acrylic acid copolymer binder (PBAN). In this system, a quaternary benzyl alkyl ammonium chloride may be added to the binder polymer in its manufacturing process to ensure that the polymer will cure properly in the final propellant. The binder polymer contains polarizable functional groups along its nitrile "backbone." The chemical structure of the polymer and the added quaternary ammonium salt are theorized to together result in a binder system with relatively high electrical conductivity. The relative contribution of each is unsubstantiated, however.

Quaternary ammonium salts have been used as antistatic agents in other industries to impart antistatic properties to fabrics, and in the manufacture of antistatic plastic products for sensitive electronic component manufacture.

In contrast to the particular fore-mentioned propellants using a PEG or PBAN binder, other propellants such as those using a hydroxyl-terminated polybutadiene (HTPB) binder have an intrinsic high insulative value, and are susceptible under certain circumstances to high charge build-up with accompanying catastrophic consequences resulting from breakdown discharge. Despite the dangers attendant to making and using such propellants, methods for reducing such dangers by modification of the propellant formulation have not been previously developed.

SUMMARY OF THE INVENTION

It has been discovered that an additive salt of a composition as defined herein may be combined in a solid propellant to alter its electrical characteristics. The conductivity is significantly increased as demonstrated by reduced electrical resistivity and reduced charge retention time. The increased ability to dissipate electrical charges at low potential reduces the possibility of high potential electrostatic discharge, and the resulting ignition.

The effect of this additive upon combustion properties of the propellant is generally small, and in some cases may be insignificant. The method of this invention is generally applicable to solid propellants having a hydrocarbon binder, and is particularly applicable to composite propellants having a high volume resistivity at room temperature, i.e., generally greater than about $100{,}000\times10^{11}$ ohm-cm. An example of such a propellant is that used in the Peacekeeper ballistic missile booster rocket motor, an ammonium perchlorate-aluminum based propellant with a hydroxyl-terminated polybutadiene (HTPB) binder.

The additive of this invention has the general formula:

$(R_3R'A)B_n$ alternatively shown as:

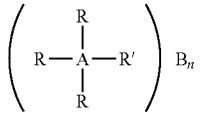

where:

R and R' are aliphatic and/or aromatic groups;

A is a Group V element, in particular one or more of the group consisting of P, As and Sb;

B is a counterion; and n is the number of counterions required to electrostatically balance the additive.

The additive is included in the solid propellant formulation at a low concentration, typically 0.02 to 0.25 percent by weight. This is equivalent to about 0.1 to 2.5 percent by weight of the binder.

BRIEF DESCRIPTION OF THE DRAWINGS

FIG. 1 is a semi-logarithmic graphical representation of certain electrical properties of a propellant including a range of concentrations of the phosphonium salt additive of the invention;

FIG. 2 is a semi-logarithmic graphical representation of the volume resistivity of a propellant binder including various types and concentrations of electrolyte additives of the invention; and FIG. 3 is a graphical representation of the specific impulse of a propellant including a concentration range of an electrolyte additive according to the invention.

DESCRIPTION OF THE PREFERRED EMBODIMENTS

In the general formula,

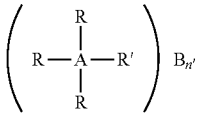

R and R' are aliphatic groups which may be saturated, i.e., alkanes, or unsaturated, i.e., olefins, diolefins and alkynes. Alternatively, R and R' may be aromatic groups such as phenyl or benzyl groups.

Substituted aliphatic and aromatic groups are also useful in this invention as R and/or R'.

As further described below, A is a Group V atom, and B is a counterion where n indicates the number of B counterions required to approximately balance the salt electrostatically.

Counterion B may be any anion which is compatible with the propellant components and other components of the rocket motor. A non-exhaustive list of such useful counterions includes bromide, chloride, iodide, nitrate, cyanide, cyanate, thiocyanate and dodecylsulfate as examples.

A wide variety of quaternary salts having the given formula may be utilized as the propellant additive.

Whether R and R' are aliphatic or aromatic groups, it is preferable to choose the groups such that the molecular weight of the salt is as low as possible, yet without appreciable proclivity for ion pairing or triplet formation. The charge concentration per unit mass is thereby maximized, and the quantity of additive required is minimized. In general, it is desirable that R and R' have no more than ten carbon atoms. More preferably, each R group has no more than 6 carbon atoms.

In addition, for ease of processing, it is preferred that the additional salt is a liquid. This has been found to occur when the R group and R' group differ, forming an unsymmetrical substitution about the central atom A.

The viscosity of the quaternary salt is a function of the difference between R and R'. Thus, for example, the symmetrical salt, tetrabutyl phosphonium bromide in which all R groups are equivalent is a solid crystalline material at temperatures below 60° C. The unsymmetrical salt, tributyl decyl phosphonium bromide by contrast is a viscous liquid at room temperature.

More importantly, the differences between R and R' may affect the practical solubility of the salt in polymeric binders. For example, the symmetrical salt tetrabutyl phosphonium bromide is dissolved in liquid hydroxyl-terminated polybutadiene only with heating above 60° C. and rapid agitation, whereas the unsymmetrical compounds based on tributyldecyl phosphonium salts are easily dissolved in the polymeric binder at ambient temperatures.

The aliphatic and/or aromatic groups chosen must be compatible with the Group V element. Thus, materials containing freely acidic groups such as carboxylic acids, phenols, mercaptans and the like are not suitable since these tend to produce protic salts rather than the desired quaternized compounds. Likewise, reactive or oxidizing materials such as azides, aziridines, isocyanates, peroxides, etc., are also not suitable due to undesirable side reactions and product rearrangements.

R and R' may also be substituted aliphatic or aromatic groups. For example, use of a nitro substituted group increases the reactivity, enhancing the charge transfer. In addition, the phosphonium salt is more readily formed from such reactive substituted R and R' groups. Other substituted R and R' groups, which are useful, include alkyne and nitrile substituted aliphatic or aromatic groups.

The Group V atoms, which may be used as A in the representative structure, are phosphorus P, arsenic As and antimony Sb. Bismuth does not readily quaternize and therefore is believed to be impractical in this invention.

Quaternary ammonium salts are soluble in hydroxyl-terminated polybutadiene (HTPB) and other binders, and are effective at increasing conductivity. However, their use in the commonly used ammonium perchlorate (AP) based propellants results in anion exchange with AP, reducing their effectiveness in increasing conductivity. The phosphonium salts are much less susceptible to anion exchange, and retain the charge transport properties necessary to reduce electrostatic sensitivity in propellants. However, at higher concentrations, the phosphonium salts tend to interfere with the curing of HTPB propellants, and also suppress the burning rates relative to the ammonium salts or untreated propellant. This effect may be anticipated to be mitigated by incorporating additional cure accelerators and/or ballistic catalysts such as iron oxide into the propellant composition.

The preferred method of producing the propellant grain includes the steps of:

(a) combining the electrolyte additive with the binder material at a concentration of 0.1-2.5 percent by weight;

(b) combining the additive-containing binder with the solid particles, e.g., fuel and oxidizer; to form an uncured propellant; and (c) curing the uncured propellant to form the solid grain.

Example 1

Propellant samples were prepared having the following composition:

| | |
|---|---|
| Total Solids | 87% |
| Ammonium perchlorate | 68% |
| Magnesium (powdered) | 19% |
| Binder (HTPB) | 13% |

In three comparative sample sets, one of the following quaternary salt was incorporated in the binder:

a) tributyl decyl phosphonium bromide (TBDPB) at 0.05% b) tributyl decyl phosphonium bromide (TBDPB) at 0.1% c) tetra octyl ammonium bromide (TOAB) at 0.1%

Electrostatic tests were conducted on each sample at three different temperatures at 20% relative humidity. The results were as follows:

| ADDITIVE | Temp F.° | Volume Resistivity ohm-cm × $10^{11}$ | Surface Resistivity ohm-cm × $10^{11}$ | Dielectric Const. | Relax. Time Seconds |
|---|---|---|---|---|---|
| 0.05% TBDPB | −18 | 21,400 | 237,000 | 5.9 | 1129.58 |
| | +71 | 431 | 898 | 5.3 | 20.23 |
| | +133 | 15.9 | 72.8 | 6.3 | 0.88 |
| 0.1% TBDPB | −20 | 10,400 | 21,800 | 5.9 | 550.33 |
| | +71 | 47.7 | 26.1 | 5.9 | 2.51 |
| | +128 | 4.83 | 8.07 | 5.3 | 0.23 |
| 0.1% TOAB | −22 | 80,400 | 33,300 | 5.6 | 4015.14 |
| | +71 | 1160 | 4630 | 5.6 | 57.86 |
| | +123 | 122 | 561 | 5.9 | 6.44 |

The phosphonium salt was more effective than the ammonium salt for reducing the resistivity and relaxation time of the propellant. As expected, the electrostatic properties are temperature dependent, with dissipation occurring more rapidly at higher temperatures. Also, the unsymmetrically substituted salt TBDPB was more effective than the symmetrical TOAB at reducing resistivity, i.e., increasing conductivity.

Example 2

Samples of a standard HTPB/Magnesium/AP propellant were prepared. These samples included added electrolytes as follows:

(a) none (baseline samples)

(b) 0.25% tetrabutyl phosphonium dodecyl sulfate (TBPDS), and (c) 0.25% tributyl decyl phosphonium bromide (TBDPB)

Electrostatic tests were conducted at 75° F. with the following results:

| ADDITIVE | None | 0.25% TBPDS | 0.25% TBDPB |
|---|---|---|---|
| Volume Resistivity ohm-cm | 5.6 × $10^{13}$ | 2.1 × $10^{13}$ | 0.21 × $10^{13}$ |

-continued

| ADDITIVE | None | 0.25% TBPDS | 0.25% TBDPB |
|---|---|---|---|
| Surface Resistivity ohm-cm | 22 × $10^{13}$ | 8.15 × $10^{13}$ | 0.039 × $10^{13}$ |
| Dielectric Constant | 5.3 | 4.2 | 5.3 |
| Relaxation Time Seconds | 26.26 | 8.69 | 0.99 |

Both additives reduced the resistivity, but the additive (TBDPB) with unsymmetrical R groups was significantly more effective. Other tests conducted on these samples were as follows:

| ADDITIVE | None | 0.25% TBPDS | 0.25% TBDPB |
|---|---|---|---|
| End of Mix Viscosity, kP | 8.3 | 9.6 | 18.6 |
| Pot life (hour) to 40 KPat 135° F. | 4.5 | 6.0 | 6.0 |
| Hardness, Shore A | 82 | 60 | 50 |
| Burning Rate at 1000 psi, inches per second | 0.495 | 0.474 | 0.453 |
| Burning Rate Exponent, n | 0.41 | 0.41 | 0.40 |

A slight inhibition of cure is observed in propellant with electrolyte additive.

The hardness of the propellant grain also decreased, but it was nevertheless wholly acceptable. Furthermore, there was a slight reduction in burning rate. Both additives increased the end-of-mix viscosity, particularly the TBDPB.

Example 3

As illustrated in the table below, the burning rate as well as hardness and binder viscosity (measured at End of Mix EOM) are affected by the type and concentration of quaternary salt additive.

| ADDITIVE | None | Tetraoctyl Ammonium Bromide | Tributyl Decyl Phosphonium Bromide | | |
|---|---|---|---|---|---|
| Concentration, % | 0 | 0.1 | 0.05 | 0.1 | 0.25 |
| Hardness, Shore A | 82 | 81 | 83 | 73 | 50 |
| Burning Rate at 1000 psi, inches per second | 0.495 | 0.496 | 0.492 | 0.487 | 0.453 |
| Viscosity, EOM, kP | 8.0 | 17.0 | 16.0 | 18.0 | 19.0 |

Thus, the ballistic, mechanical and processing property effects must be considered in selecting the particular electrolyte additive and its concentration.

The ideal additive will be one which is a liquid, and produces the desired conductivity increase at a low concentration, with no or minimal change in specific impulse, hardness, and viscosity, and without introducing undesirable chemical species into the propellant.

At concentrations between about 0.02 and 0.25 percent by weight of propellant, the indicated phosphonium salts are very effective at dissipating electrostatic charges, and processing and ballistic effects are minimal. Preferably, the concentration of electrolyte additive is about 0.05 to 0.1 percent. The optimum concentration will depend on the particular electrolyte selected, including its molecular weight and formula, inclusion of active groups, etc., as well as the general propellant formulation and manufacturing process. The foregoing test results indicate that reductions in resistivity of 100-fold or more are possible at low electrolyte concentrations, greatly increasing inherent safety of the propellant.

Reference herein to details of the illustrated embodiments of the invention is not intended to restrict the scope of the appended claims, which themselves recite the features regarded as important to the invention.

What is claimed is:

1. A process for reducing the electrostatic charge retention of a solid propellant comprising:

including as an ingredient in a solid propellant an electrolyte additive represented by the following formula:

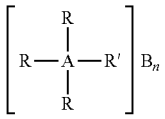

wherein R and R' are at least one of an aliphatic group, a substituted aliphatic group, an aromatic group, and a substituted aromatic group;

A is phosphorus, arsenic, or antimony;

B is a negatively charged counterion; and n is the number of negatively charged counterions required to electrostatically balance the electrolyte additive.

2. The process of claim 1, wherein including as an ingredient in a solid propellant an electrolyte additive comprises including a polymeric binder and solid particles in the solid propellant comprising combining the electrolyte additive with the polymeric binder, combining the additive-containing polymeric binder with the solid particles to form an uncured propellant, and curing the uncured propellant to form a grain.

3. The process of claim 1, wherein including as an ingredient in a solid propellant an electrolyte additive comprises including the electrolyte additive in the solid propellant at a concentration of from about 0.02 percent by weight to 0.25 percent by weight of the solid propellant.

4. The process of claim 1, wherein including as an ingredient in a solid propellant an electrolyte additive comprises including the electrolyte additive in the solid propellant at a concentration of from about 0.05 percent by weight to 0.1 percent by weight of the solid propellant.

5. The process of claim 2, wherein combining the electrolyte additive with the polymeric binder comprises mixing the electrolyte additive with the polymeric binder at a concentration of from about 0.2 percent by weight to 2.5 percent by weight of the polymeric binder.

6. The process of claim 2, wherein curing the uncured propellant to form a grain comprises curing the uncured propellant to form a rocket motor grain.

7. The process of claim 1, wherein including as an ingredient in a solid propellant an electrolyte additive comprises utilizing a counterion B comprising at least one of bromide, chloride, iodide, nitrate, cyanide, cyanate, thiocyanate, and dodecylsulfate in the electrolyte additive.

8. The process of claim 2, wherein including a polymeric binder and solid particles in the solid propellant comprises including hydroxyl-terminated polybutadiene as the polymeric binder in the solid propellant.

9. The process of claim 1, wherein including as an ingredient in a solid propellant an electrolyte additive comprises utilizing the electrolyte additive comprising different R and R' are groups.

10. The process of claim 1, wherein including as an ingredient in a solid propellant an electrolyte additive comprises utilizing an electrolyte additive comprising phosphorus as A and an aliphatic group, a substituted aliphatic group, an aromatic group, or a substituted aromatic group as R and R', each of the aliphatic group, substituted aliphatic group, aromatic group, or substituted aromatic group having ten or less carbon atoms.

11. A process for reducing an electrostatic charge retention of a solid propellant comprising:

blending a solid propellant comprising ammonium perchlorate (AP) with an electrolyte additive represented by the following formula:

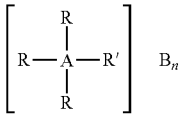

wherein R and R' are at least one of an aliphatic group, a substituted aliphatic group, an aromatic group, and a substituted aromatic group;

A is phosphorus, arsenic, or antimony;

B is a negatively charged counterion; and n is the number of counterions required to electrostatically balance the electrolyte additive.

12. The process of claim 11, wherein blending a solid propellant comprising ammonium perchlorate (AP) with an electrolyte additive comprises blending the solid propellant with a liquid electrolyte additive comprising different R and R' groups.

13. An electrolyte additive for reducing an electrostatic charge retention of a solid propellant, comprising:

a quaternary salt represented by the following formula:

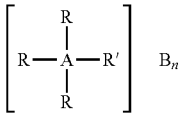

wherein each of R and R' is at least one of a nitro substituted aromatic group, an alkyne substituted aromatic group, and a nitrile substituted aromatic group;

A is phosphorus, arsenic, or antimony;

B is a negatively charged counterion; and n is the number of counterions required to electrostatically balance the quaternary salt.

14. The electrolyte additive of claim 13, wherein the quaternary salt comprises a liquid phosphonium salt wherein:

A is phosphorus;

R and R' are differing groups; and

B is at least one of chloride, bromide, iodide, nitrate, cyanide, cyanate, thiocyanate, and dodecylsulfate.

15. The electrolyte additive of claim 13, wherein R or R' is a nitro substituted benzyl group, an alkyne substituted benzyl group, a nitrile substituted benzyl group, a nitro substituted phenyl group, an alkyne substituted phenyl group, or a nitrile substituted phenyl group.

* * * * *